US008296912B2

(12) United States Patent
Shiou et al.

(10) Patent No.: US 8,296,912 B2
(45) Date of Patent: Oct. 30, 2012

(54) BURNISHING TOOL

(75) Inventors: Fang-Jung Shiou, Taipei (TW); Chuing-Hsiung Chuang, Taipei (TW)

(73) Assignee: National Taiwan University of Science and Technology, Taipei (TW)

( * ) Notice: Subject to any disclaimer, the term of this patent is extended or adjusted under 35 U.S.C. 154(b) by 1118 days.

(21) Appl. No.: 12/169,646

(22) Filed: Jul. 9, 2008

(65) Prior Publication Data

US 2009/0178261 A1 Jul. 16, 2009

(30) Foreign Application Priority Data

Jan. 16, 2008 (TW) ..... 97101575 A

(51) Int. Cl.
*B21C 37/30* (2006.01)

(52) U.S. Cl. ..... 29/90.01
(58) Field of Classification Search ..... 29/90.01
See application file for complete search history.

(56) References Cited

U.S. PATENT DOCUMENTS

| | | | | |
|---|---|---|---|---|
| 5,826,453 | A * | 10/1998 | Prevey, III | 72/75 |
| 2005/0155203 | A1* | 7/2005 | Prevey | 29/90.01 |
| 2007/0220727 | A1* | 9/2007 | Cheatham et al. | 29/90.01 |
| 2009/0106961 | A1* | 4/2009 | Tomioka et al. | 29/90.01 |

* cited by examiner

*Primary Examiner* — David Bryant
*Assistant Examiner* — Moshe Wilensky
(74) *Attorney, Agent, or Firm* — Jianq Chyun IP Office

(57) ABSTRACT

A burnishing tool includes a bushing portion, a burnishing component connected to the bushing portion, and a detector disposed in the bushing portion, for measuring a burnishing force performed on the burnishing component.

15 Claims, 6 Drawing Sheets

BURNISHING TOOL

CROSS-REFERENCE TO RELATED APPLICATION

This application claims the priority benefit of Taiwan application serial no. 97101575, filed on Jan. 16, 2008. The entirety of the above-mentioned patent application is hereby incorporated by reference herein and made a part of specification.

BACKGROUND OF THE INVENTION

1. Field of the Invention

The present invention relates to a burnishing tool, in particular, to a burnishing tool with a built-in force detector.

2. Description of Related Art

Generally speaking, in order to improve the surface smoothness of model inserts and cavities, techniques of grinding, lapping, or polishing are used. However, these processing techniques require a long processing time and easily generate abrasion of the grinding wheels and polishing balls, and the equipments used in the processing are expensive. In addition to the above-mentioned techniques, the burnishing technique is also a common finishing technique. During the burnishing operation, when the burnishing component contacts the workpiece, the produced extruding force (burnishing force) may plastically deform the workpiece, so as to improve the surface smoothness and surface hardness of the workpiece. The burnishing component is usually made of hard materials to avoid abrasion. Thus, the burnishing component is adapted for a large-scale finishing process, and the time of the surface finishing process may also be shortened. As the burnishing force is one of the crucial factors affecting the processing accuracy, how to figure out the burnishing force performed on the burnishing component becomes an important issue.

SUMMARY OF THE INVENTION

Accordingly, the present invention is directed to a burnishing tool with a built-in detector.

A burnishing tool includes a bushing portion, a burnishing component connected to the bushing portion, and a detector disposed in the bushing portion, for measuring a burnishing force performed on the burnishing component.

In order to make the aforementioned and other objectives, features, and advantages of the present invention comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
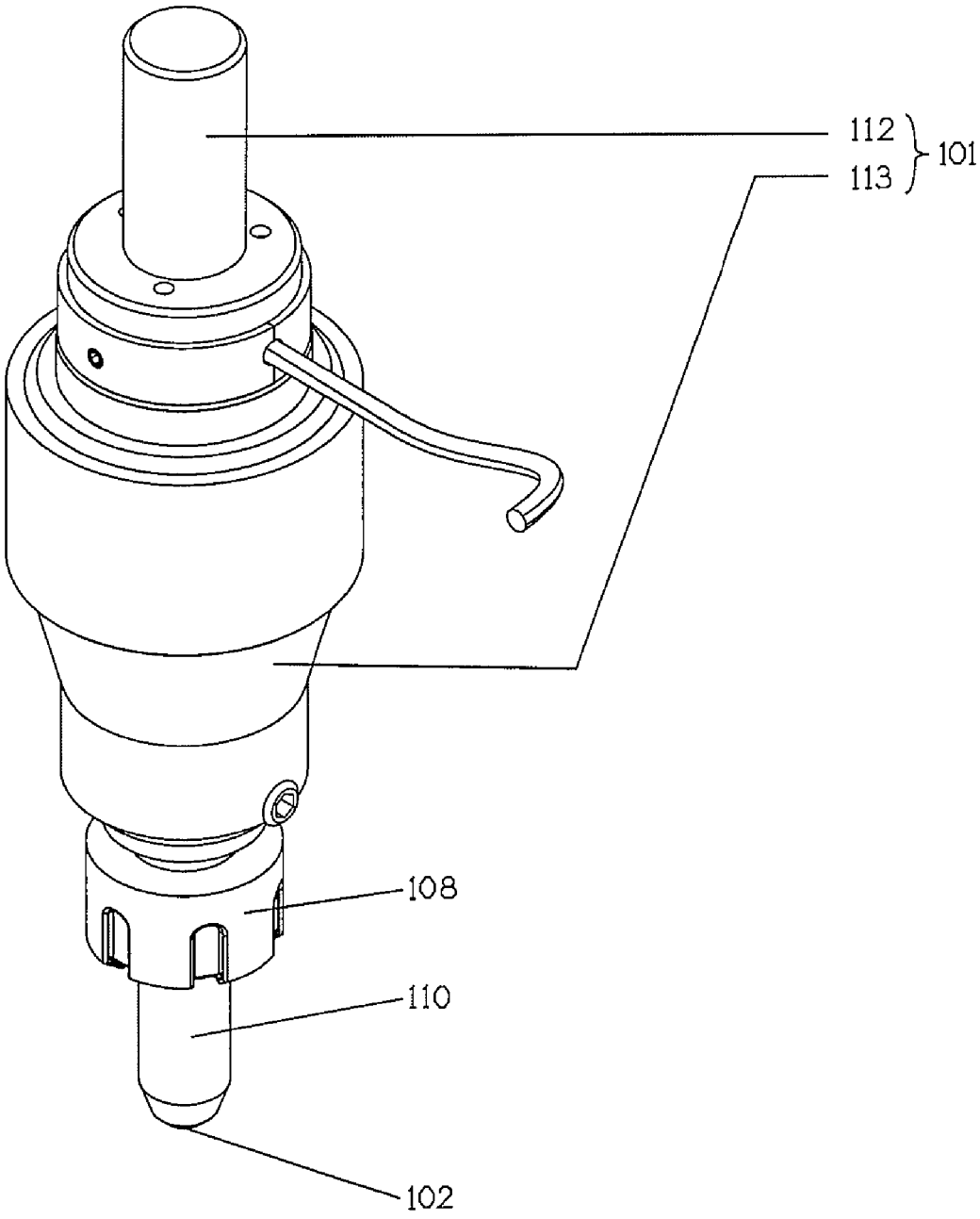
FIG. 1 is a three-dimensional view of a burnishing tool according to the present invention.

Reference will now be made in detail to the present embodiments of the invention, examples of which are illustrated in the accompanying drawings. Wherever possible, the same reference numbers are used in the drawings and the description to refer to the same or like parts.

Figure 2:
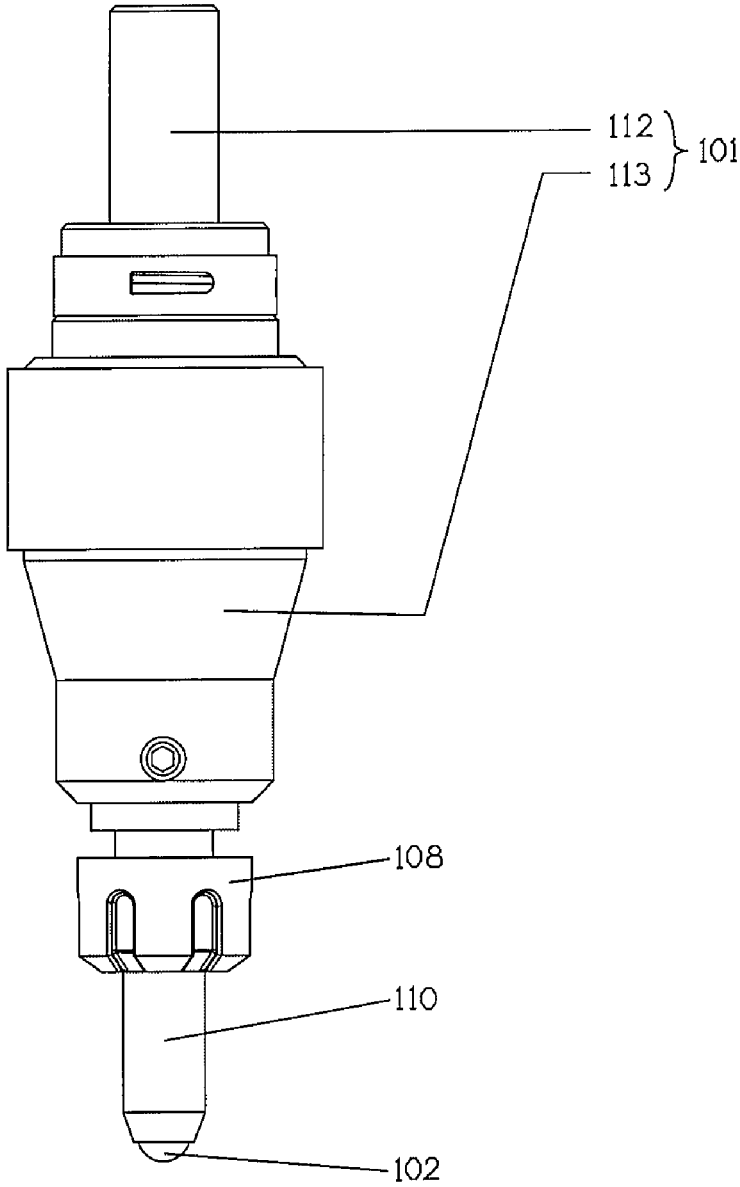
FIG. 2 is a front view of the burnishing tool in FIG. 1.
Figure 3:
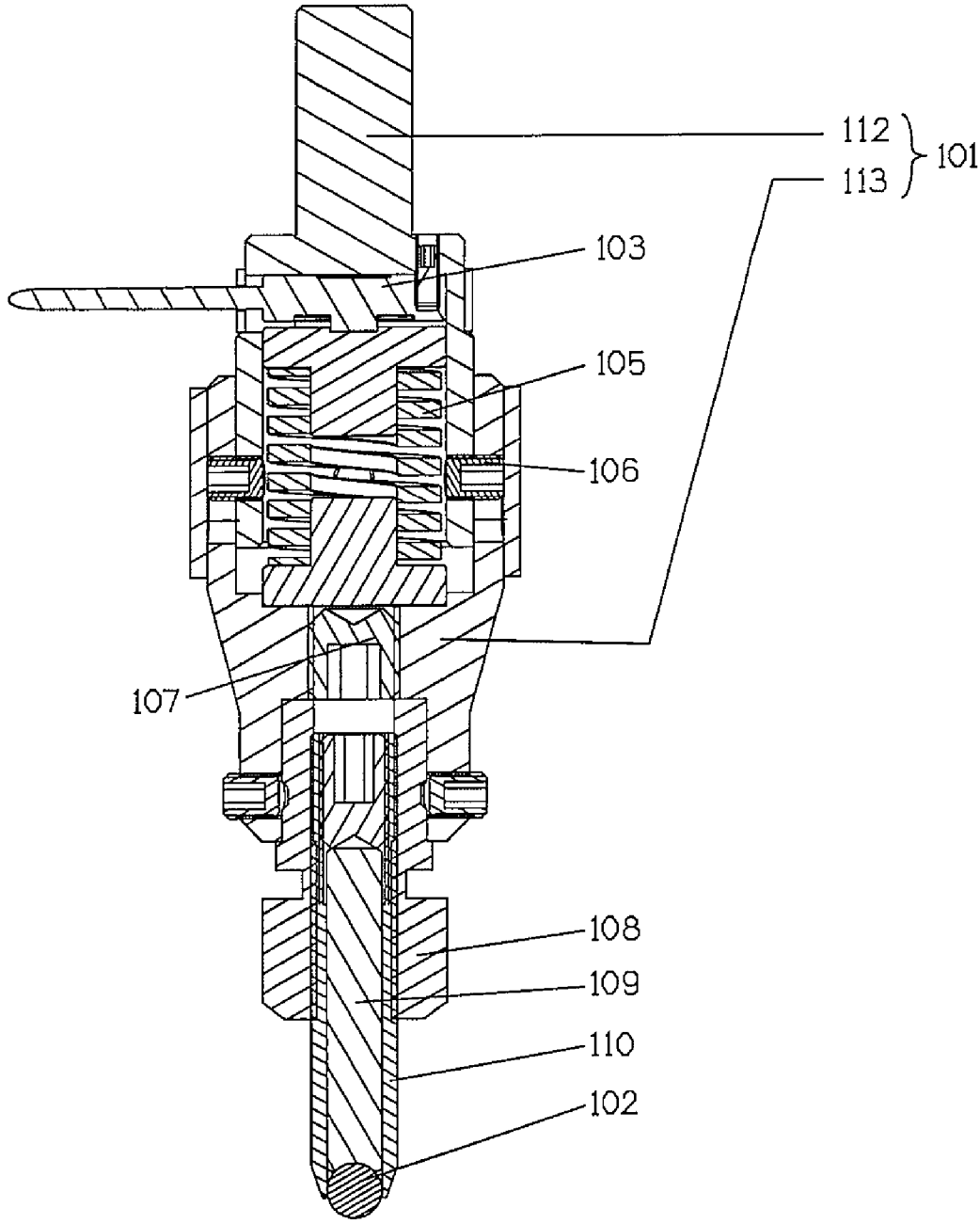
FIG. 3 is a cross-sectional view of the burnishing tool in FIG. 1.

FIG. 1 is a three-dimensional view of a burnishing tool according to the present invention. FIG. 2 is a front view of the burnishing tool in FIG. 1. FIG. 3 is a cross-sectional view of the burnishing tool in FIG. 1. As shown in the figures, in an embodiment of the present invention, the burnishing tool used for surface finishing includes a bushing portion 101, a burnishing component 102, a detector 103, an elastic component 105, a security device 106, a pre-load adjustment component 107, a sleeve nut 108, a push rod 109, and a ball rod 110.

Figure 4:
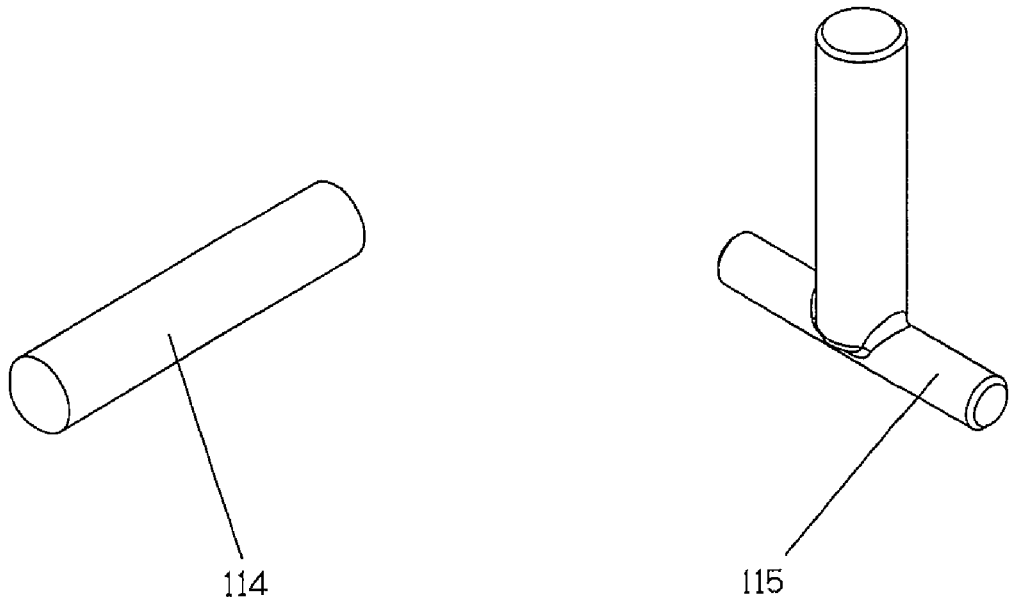
FIG. 4 is a three-dimensional view of a burnishing rod and a burnishing column.

The bushing portion 101 includes an inner bush 112 and an outer bush 113. In practice, first of all, the inner bush 112 is mounted on a tool holder on the spindle of a machine tool (such as a machining center or a milling machine), then the sleeve nut 108 is used to fasten the push rod 109, the ball rod 110, and the burnishing component 102, and finally the burnishing component 102 contacts a workpiece surface (not shown) to generate a burnishing force, thereby starting the surface finishing. In an embodiment of the present invention, the burnishing component 102 is a burnishing ball detachably fixed to the bushing portion 101. Further, in practice, the sleeve nut 108 is used to lock the push rod 109, the ball rod 110, and the burnishing component 102, and the sleeve nut 108 is mounted on the outer bush 113 of the bushing portion 101. The burnishing component 102 is made of tungsten carbide (WC) or silicon nitride ($Si_3N_4$), and the size of the burnishing ball is determined in accordance with different surface curvatures. In another embodiment of the present invention, the burnishing component 102 may have different shapes, such as burnishing rod or burnishing column. FIG. 4 is a three-dimensional view of a burnishing rod 114 and a burnishing column 115. Further, a rolling burnishing component (for example, a burnishing ball) is adapted for a relatively flat curved surface, and the processing angle is about ±30°. The sliding burnishing component (for example, a burnishing rod with an end of ground and polished spherical surface) is adapted for a relatively steep curved surface. In the present invention, the size of the bushing in the sleeve nut 108 may be changed to replace different burnishing components 102.

The detector 103 is a load detector or a load cell disposed in the inner bush 112 of the bushing portion 101, for measuring a burnishing force performed on the burnishing component 102. In practice, the detector 103 can sense the induced force upon which the burnishing component 102 contacts the workpiece surface. Moreover, through the detector 103 and an analysis program for measuring the processing force, a current burnishing force performed on the burnishing component 102 can be figured out for a subsequent analysis on the force change of the burnishing process. Thereby, the burnishing force of the burnishing process and the processing stability can be improved, and the function of digital force measurement is provided.

The elastic component 105 is a spring disposed in the bushing portion 101, for providing a burnishing force of the burnishing component 102. Further, the counterforce of the elastic component 105 may generate the burnishing force required by the burnishing process. Moreover, the elastic component 105 may eliminate positioning errors generated when the burnishing component 102 moves along a path on a free curved surface, absorb the mechanical vibration, and reduce the adhesion caused by friction between the burnishing component 102 and the workpiece, so as to protect the operating surface.

The security device 106 is connected to the bushing portion 101, for restricting the maximum deformation of the elastic component 105, and further limiting the maximum force performed on the detector 103 to avoid overload. In addition, when the elastic component 105 is over-compressed, an excessive burnishing force will be generated, and may damage the detector 103. Therefore, the security device 106 limits the maximum movement of the elastic component 105 through a guide slot travel of the outer bush 113, so as to avoid overload.

The pre-load adjustment component 107 is a screw disposed in the bushing portion 101, for adjusting an initial pre-load (i.e., an initial pre-load of the elastic component 105) of the burnishing component 102.

Figure 5:
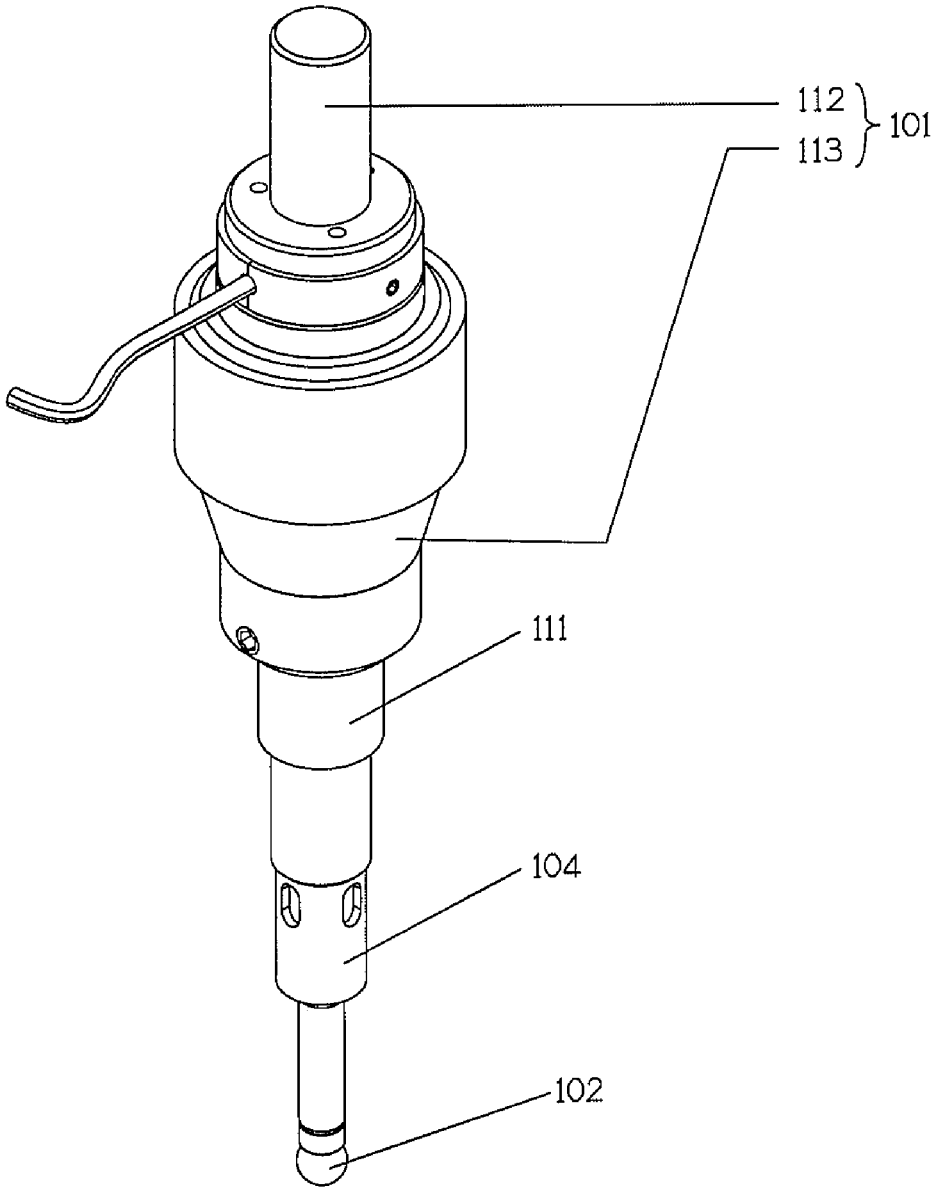
FIG. 5 is a three-dimensional view of a burnishing tool equipped with an edge detector according to the present invention.
Figure 6:
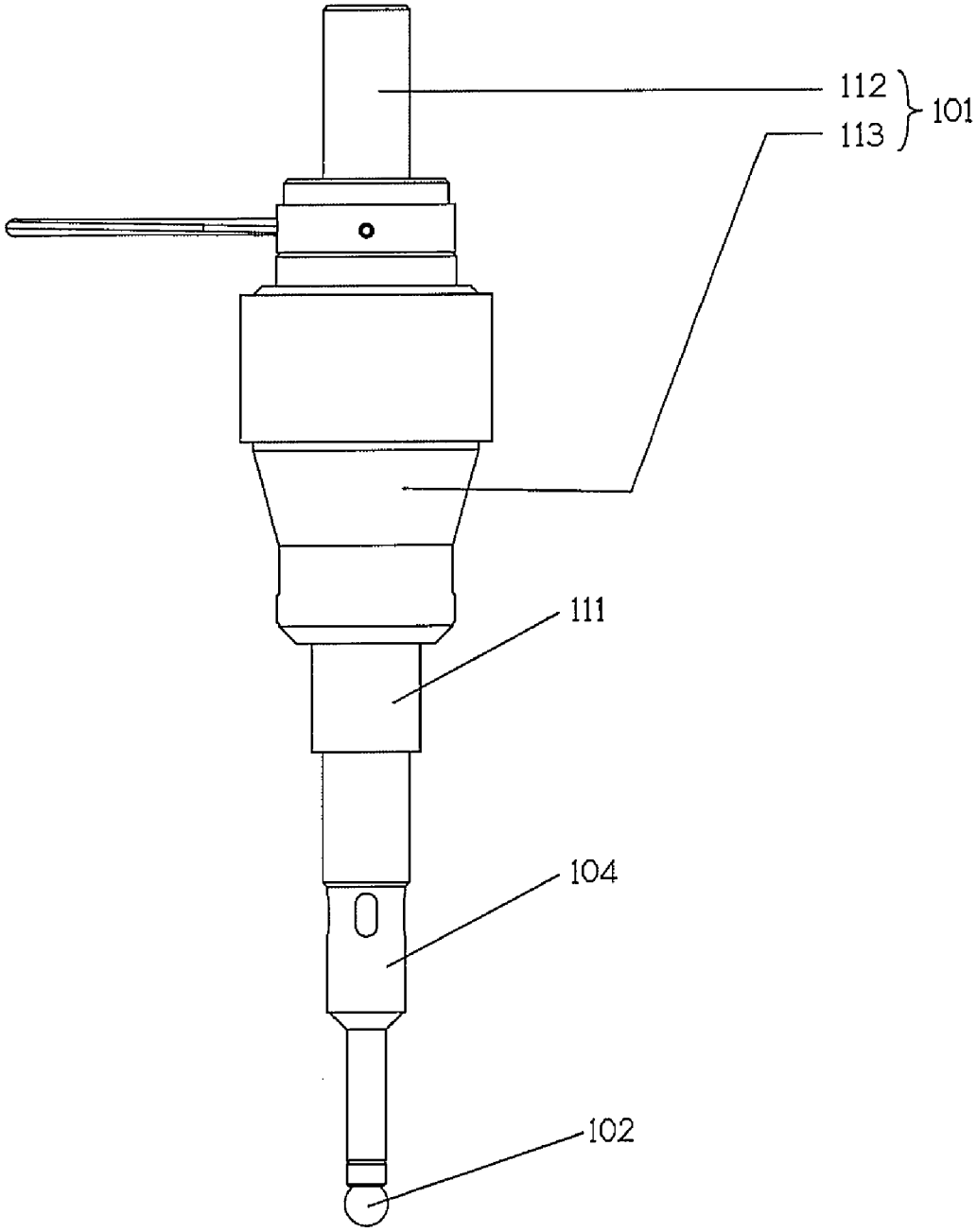
FIG. 6 is a front view of the burnishing tool in FIG. 5.

In an embodiment of the present invention, the burnishing tool further includes an edge detector 104 and a measurement jig 111. FIG. 5 is a three-dimensional view of a burnishing tool equipped with an edge detector 104 according to the present invention. FIG. 6 is a front view of the burnishing tool in FIG. 5. As shown in FIG. 6, in an embodiment of the present invention, the edge detector 104 is a photoelectric edge detector connected to the bushing portion 101, for detecting edges of a workpiece and positioning the center of the burnishing component 102. In practice, the sleeve nut 108 is first detached from the outer bush 113 of the bushing portion 101, then the measurement jig 111 is mounted, and further the measurement jig 111 is used to fasten the edge detector 104, so as to fulfil the edge finding and positioning functions. In addition, the edge detector 104 moves together with the burnishing component 102. In other words, in the present invention, the burnishing tool may conduct the edge finding, positioning, and burnishing processes at the same time. Further, as edge finding and positioning are factors critical to the processing accuracy, the burnishing tool provided by the present invention may achieve a high processing accuracy.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A burnishing tool, comprising:

a bushing portion;

a burnishing component, connected to the bushing portion;

a detector, disposed in the bushing portion, for measuring a burnishing force performed on the burnishing component; and an edge detector, connected to the bushing portion, for detecting edges and positioning the center of the burnishing component, wherein the edge detector moves together with the burnishing component.

2. The burnishing tool according to claim 1, wherein the detector senses the induced force upon which the burnishing component contacts the workpiece surface.

3. The burnishing tool according to claim 1, wherein the burnishing component is detachably fixed to the bushing portion.

4. The burnishing tool according to claim 1, wherein the edge detector is a photoelectric edge detector.

5. The burnishing tool according to claim 1, further comprising:

a security device, connected to the bushing portion, wherein the bushing portion is provided with a guide slot, and the security device comprises a pin slidably disposed in the guide slot for limiting a maximum force performed on the detector.

6. The burnishing tool according to claim 1, further comprising:

an elastic component, disposed in the bushing portion, for providing a burnishing force of the burnishing component.

7. The burnishing tool according to claim 6, wherein the elastic component is a spring.

8. The burnishing tool according to claim 1, further comprising:

an elastic component, disposed in the bushing portion, for providing a burnishing force activating on the burnishing component; and a security device, connected to the bushing portion, wherein the bushing portion is provided with a guide slot, and the security device comprises a pin slidably disposed in the guide slot for restricting a maximum deformation of the elastic component, so as to limit a maximum force performed on the detector.

9. The burnishing tool according to claim 8, wherein the elastic component is a spring.

10. The burnishing tool according to claim 1, further comprising:

a pre-load adjustment component, disposed in the bushing portion, for adjusting an initial pre-load of the burnishing component.

11. The burnishing tool according to claim 10, wherein the pre-load adjustment component is a screw.

12. The burnishing tool according to claim 1, wherein the detector is a load detector.

13. The burnishing tool according to claim 1, wherein the burnishing component is a burnishing ball.

14. The burnishing tool according to claim 1, wherein the burnishing component is a burnishing rod.

15. The burnishing tool according to claim 1, wherein the burnishing component is a burnishing column.

* * * * *